US009394142B2

(12) United States Patent
Zhu et al.

(10) Patent No.: US 9,394,142 B2
(45) Date of Patent: Jul. 19, 2016

(54) MINING ELEVATOR LAPPING PLATFORM SUITABLE FOR FLEXIBLE GUIDE RAIL AND MINING ELEVATOR LAPPING METHOD

(71) Applicants: China University of Mining and Technology, Xuzhou (CN); Dongnan Elevator Co. Ltd., Suzhou (CN)

(72) Inventors: Zhencai Zhu, Xuzhou (CN); Guohua Cao, Xuzhou (CN); Jiancong Qin, Xuzhou (CN); Hongqiao Kang, Xuzhou (CN); Wei Li, Xuzhou (CN); Gongbo Zhou, Xuzhou (CN); Guoan Chen, Xuzhou (CN); Renyuan Wu, Xuzhou (CN); Yiping Ma, Xuzhou (CN); Jianrong Yang, Xuzhou (CN)

(73) Assignees: China University of Mining and Technology, Jiangsu (CN); Dongnan Elavator Co. Ltd., Jiangsu (CN)

( * ) Notice: Subject to any disclaimer, the term of this patent is extended or adjusted under 35 U.S.C. 154(b) by 176 days.

(21) Appl. No.: 14/383,693
(22) PCT Filed: Mar. 25, 2013
(86) PCT No.: PCT/CN2013/073105
§ 371 (c)(1),
(2) Date: Sep. 8, 2014
(87) PCT Pub. No.: WO2013/143423
PCT Pub. Date: Oct. 3, 2013

(65) Prior Publication Data

US 2015/0037125 A1 Feb. 5, 2015

(30) Foreign Application Priority Data

Mar. 27, 2012 (CN) ..... 2012 1 0083199

(51) Int. Cl.
*B66B 13/28* (2006.01)
*B66B 17/16* (2006.01)
(Continued)

(52) U.S. Cl.
CPC ..... *B66B 17/16* (2013.01); *B66B 13/301* (2013.01); *B66B 17/18* (2013.01)

(58) Field of Classification Search
CPC ..... B66B 17/18; B66B 17/16; B66B 13/24; B66B 13/28; B66B 13/301
USPC ..... 14/69.1, 71.1, 71.3; 187/334, 313, 400, 187/315, 324; 414/639
See application file for complete search history.

(56) References Cited

U.S. PATENT DOCUMENTS 2,120,081 A * 6/1938 Alexander ..... B66B 17/18 14/50
2,473,125 A * 6/1949 Alexander ..... B66B 17/18 14/71.1

(Continued)

FOREIGN PATENT DOCUMENTS

CN 27807040 5/2006
CN 102602788 7/2012

(Continued)

OTHER PUBLICATIONS

International Search Report re PCT/CN2013/073105, dated Jul. 4, 2013, 6 pgs.

*Primary Examiner* — Saul Rodriguez
*Assistant Examiner* — Mark Hageman
(74) *Attorney, Agent, or Firm* — Greenberg Traurig, LLP

(57) ABSTRACT

A mining elevator lapping platform suitable for a flexible guide rail and a mining elevator lapping method. The lapping platform mainly comprises a support claw package (1) and a power package (2), wherein the support claw package (1) comprises a mounting plate (1-14), a screw rod bearing base (1-15), a screw rod (1-4), a screw nut (1-2), a support rod (1-5), a pushing rod (1-3), a support claw (1-6). a footboard (1-7), a guide rail (1-9) and a guide rail frame (1-12); the power package (2) comprises an explosion-proof motor (2-1) and a bevel gear; and the support claw package (1) and the power package (2) are both installed on a cross beam (3) below an elevator car. The lapping method is as follows: the sharing between a lapping platform and a plurality of horizontal planes is realized, the self-locking function is achieved, the reliable connection of the lapping platform in the plurality of horizontal planes is met, the reliable lapping between the elevator car and a hoistway layer door is realized, and the mining elevator lapping platform plays a role in safety protection, and convenience of getting in and out of the elevator for cargos and people.

2 Claims, 2 Drawing Sheets

(51) Int. Cl.
*B66B 13/30* (2006.01)
*B66B 17/18* (2006.01)

(56) References Cited

U.S. PATENT DOCUMENTS 2,473,127 A * 6/1949 Alexander ..... B66B 17/18 14/71.1
2,473,128 A * 6/1949 Alexander ..... B66B 17/18 14/71.1
2,739,354 A * 3/1956 Pope ..... B66B 17/18 187/334
2,772,753 A * 12/1956 Nordgard ..... B66B 17/18 187/360
6,565,068 B1 5/2003 Arzouman
7,621,379 B2 * 11/2009 Miller ..... B66B 13/24 187/330

FOREIGN PATENT DOCUMENTS

CN 202542656 11/2012
EP 0386273 12/1990

* cited by examiner

MINING ELEVATOR LAPPING PLATFORM SUITABLE FOR FLEXIBLE GUIDE RAIL AND MINING ELEVATOR LAPPING METHOD

TECHNICAL FIELD

The present invention relates to an elevator lapping platform and a lapping method, in particular to a mining elevator lapping platform and a lapping method suitable for flexible guide rail.

BACKGROUND

As mine production is developed towards the trend of centralized and large-scale production, lifting efficiency of mining elevators that serve as the transport means for transporting persons and materials among horizontal planes in mine shafts (blind shafts) is improved significantly, but the requirements on safety and reliability are much higher. At present, most elevators employ a rigid guide rail that is in small clearance to the elevator car and there is no lapping platform on the shaft way. However, the guide rail may be easy to lean, distort, slope, or locally bulge in the harsh environment in the mine, resulting in potential risks, for example, the lift car may be stuck on the guide rail. Though existing mine elevator systems use a carrying device and swing deck for lapping between the cage and the shaft way, all these devices are mounted at the head of the shaft way, and a set of devices must be provided at each horizontal plane. This arrangement is not suitable for lapping among intermediate horizontal working planes, and is not suitable for lapping of mining elevators. At present, there is no mining elevator lapping platform that is suitable for flexible guide rail.

DETAILED DESCRIPTION

Figure 1:
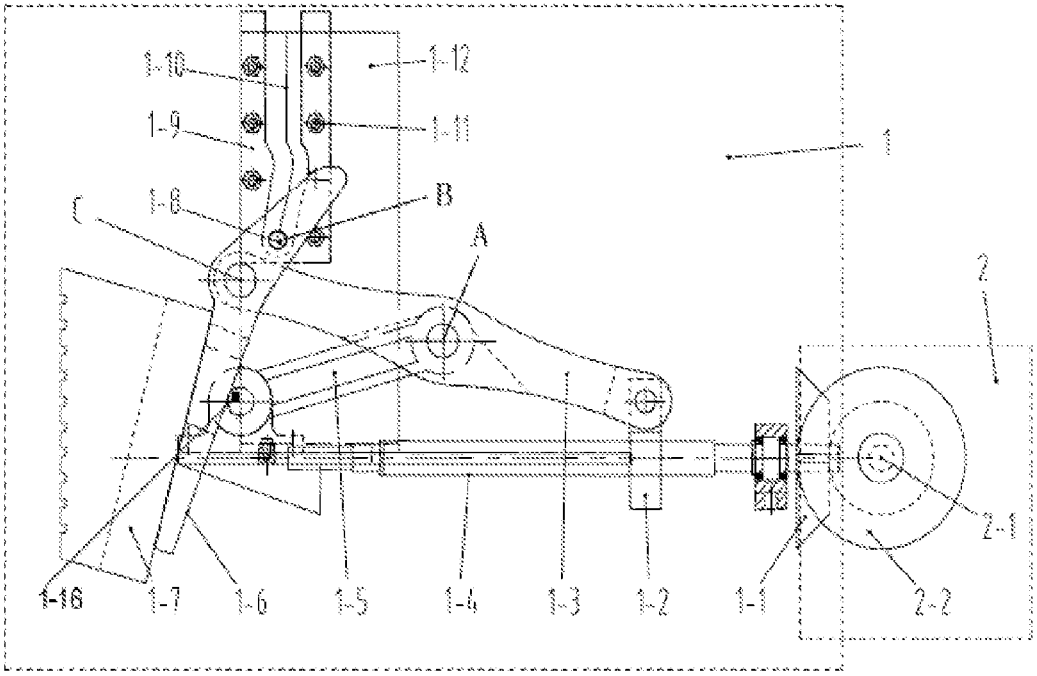
FIG. 1 is a front structural view of the mining elevator lapping platform according to the present invention.

To overcome the drawbacks in the prior art, the present invention provides a mining elevator lapping platform suitable for flexible guide rail, which has advantages such as simple structure, high safety, high action accuracy, and easy operation; in addition, the present invention provides a lapping method thereof.

The mining elevator lapping platform suitable for flexible guide rail in the present invention mainly comprises a support claw package and a power package, wherein, the support claw package comprises two mounting plates arranged in symmetry on a bottom beam of the elevator car, a support rod shaft is arranged on the left between the two mounting plates and fixed via a mounting base, a screw rod bearing housing is arranged in the middle of the two mounting plates at certain spacing to the support rod shaft and parallel spatially to the support rod shaft, a screw rod is arranged on the screw rod bearing housing, a driven bevel gear is arranged on the right end of the screw rod, a screw rod nut is fitted over the screw rod, a push rod is hinged to the screw rod nut, a support rod is hinged to the middle part of the push rod and fixed to the support rod shaft, and the screw rod nut, push rod, support rod, and screw rod constitute an in-line slider-crank mechanism; a support claw is hinged to the other end of the push rod, a guide rail is arranged on the upper part of the support claw and fixed in a guide rail bracket via a pin shaft, and a foot board is arranged on the outer side of the lower part of the support claw; the power pack comprises an explosion-proof motor fixed to the bottom beam of the elevator car, and a driving bevel gear is arranged on the output shaft of the explosion-proof motor and engaged with the driven bevel gear.

The mining elevator lapping method suitable for flexible guide rail according to the present invention is described as follows:

to deploy the lapping platform, the explosion-proof motor drives the driving bevel gear, the driving bevel gear drives the driven bevel gear, and the driven bevel gear drives the screw rod to rotate, so that the screw rod nut fitted over the screw rod moves horizontally, and thus drives the in-line slider-crank mechanism constituted by the screw rod nut, push rod, support rod, and screw rod; the movement of the in-line slider-crank mechanism converts the movement of the push rod into upward vertical translation movement, the support rod rotates around the support rod shaft on the mounting base, and the pin shaft hinged to the support claw on the push rod moves along the trace, so that the foot board fixed to the support claw laps horizontally;

to retract the lapping platform, the explosion-proof motor rotates in reverse direction, so that the screw rod rotates in reverse direction and the screw rod nut is driven to move in reverse direction, and the support claw is retracted along the trace and is then reset.

With above solution, the goods and persons can be protected safely and can be transported into and out of the elevator conveniently; the lapping platform enables the foot board to move along a predefined trace and has a screw rod self-locking function, and can achieve reliable lapping between the mining elevator car that employs a flexible guide rail and the shaft way at multiple horizontal working planes in a mine, to ensure safe and reliable transport of persons and goods. Specifically, the solution has the following advantages:

(1) Power is transferred to the foot board by screw rod transmission, and self-locking function is provided;

(2) The lapping platform is arranged on the elevator car, and thus it is shared among multiple horizontal working planes; therefore, the initial investment for each horizontal working plane is reduced;

(3) The structure is simple, the control is accurate, the installation and maintenance is convenient, the operation is reliable, so that the load can be transported into and out of the elevator car more safely and reliably.

Figure 2:
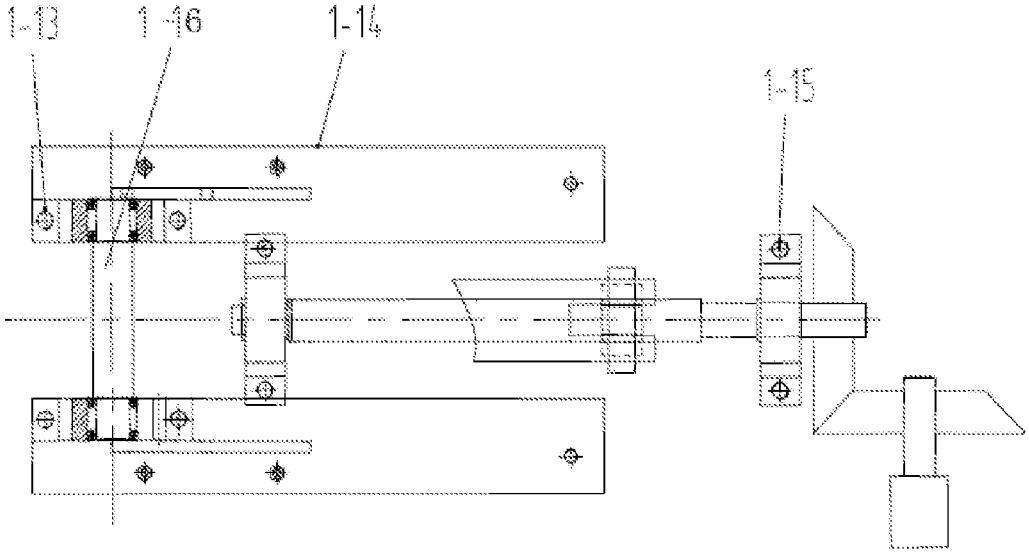
FIG. 2 is a top structural view of the mining elevator lapping platform according to the present invention.
Figure 3:
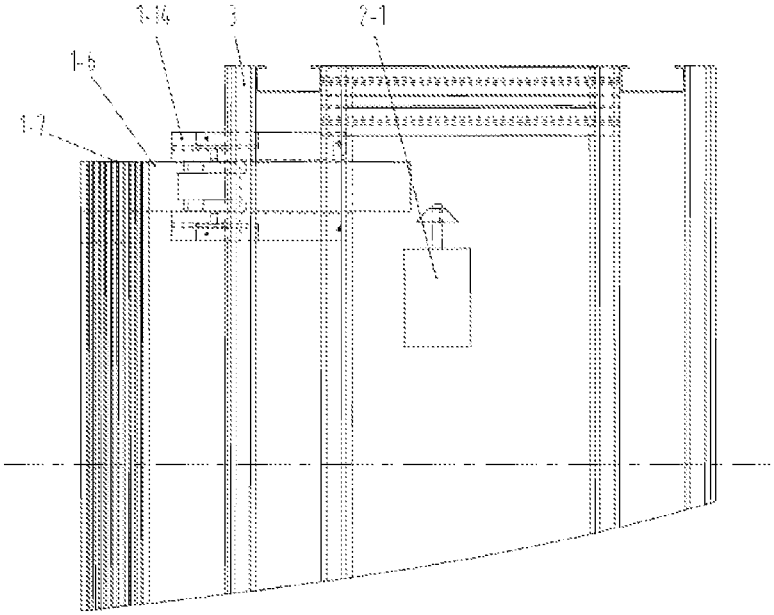
FIG. 3 is a schematic installation diagram of the mining elevator lapping platform according to the present invention.

Hereunder the present invention will be detailed in an embodiment with reference to the accompanying drawings:

As shown in FIGS. 1-3, the mining elevator lapping platform suitable for flexible guide rail in according to the present invention mainly comprises a support claw package 1 and a power package 2, wherein, the support claw package 1 and the power package 2 transfer power by means of the engagement between a driving bevel gear 2-2 on the shaft of an explosion-proof motor 2-1 in the power package 2 and a driven bevel gear 1-1 on a screw rod 1-4 in the support claw package 1; the support claw package 1 comprises two mounting plates 1-14 arranged in symmetry on a bottom beam 3 of the elevator car, a support rod shaft 1-16 is arranged on the left between the two mounting plates 1-14 and fixed via a mounting base 1-13, a screw rod bearing housing 1-15 is arranged in the middle of the two mounting plates 1-14 at certain spacing to the support rod shaft 1-16 and parallel spatially to the support rod shaft 1-16, the screw rod 1-4 is arranged on the screw rod bearing housing 1-15, the driven bevel gear 1-1 is arranged on the right end of the screw rod 1-4, a screw rod nut 1-2 is fitted over the screw rod 1-4, a push rod 1-3 is hinged to the screw rod nut 1-2, a support rod 1-5 is hinged to the middle part of the push rod 1-3, and the screw rod nut 1-2, push rod 1-3, support rod 1-5, and screw rod 1-4 constitute an in-line slider-crank mechanism; a support claw 1-6 is hinged to the other end of the push rod 1-3, the upper part of the support claw 1-6 is arranged on a guide rail 1-9 of a guide rail bracket 1-12 via a pin shaft 1-8 and moves along a trace 1-10 of the guide rail 1-9, the guide rail 1-9 is fixed to the guide rail bracket 1-12 by tightening screws 1-11, and the pin shaft 1-8 is constrained to move in the guide rail 1-9; a foot board 1-7 is arranged on the outer side of the lower part of the support claw 1-6; the power pack 2 comprises an explosion-proof motor 2-1 fixed to the bottom beam 3 of the elevator car, and a driving bevel gear 2-2 is arranged on the output shaft of the explosion-proof motor 2-1 and engaged with the driven bevel gear 1-1. The hinge point A where the support rod 1-5 is hinged to the push rod 1-3 is the middle point of the push rod 1-3, and the length of the push rod 1-3 is two times of the length of the support rod 1-5.

The lapping method for the mining elevator lapping platform suitable for flexible guide rail according to the present invention is described as follows:

to deploy the lapping platform, the explosion-proof motor 2-1 drives the driving bevel gear 2-2, the driving bevel gear 2-2 drives the driven bevel gear 1-1, and the driven bevel gear 1-1 drives the screw rod 1-4 to rotate, so that the screw rod nut 1-2 fitted over the screw rod 1-4 moves horizontally, and thus drives the in-line slider-crank mechanism constituted by the screw rod nut 1-2, push rod 1-3, support rod 1-5, and screw rod 1-4; the movement of the in-line slider-crank mechanism converts the movement of the push rod 1-3 into upward vertical translation movement, the support rod 1-5 rotates around the support rod shaft 1-16 on the mounting base 1-13, and the pin shaft 1-8 hinged to the support claw 1-6 on the push rod 1-3 moves along the trace 1-10, so that the foot board 1-7 fixed to the support claw 1-6 laps horizontally; the trace 1-10 initially constrains the support claw 1-6 to move vertically upwards under the constraint of the guide rail 1-9 and at the same time rotates around point B in a plane, and then constrains the front end of the support claw 1-6 to rotate to a horizontal position and then move vertically upwards; the push rod 1-3 of the in-line slider-crank mechanism is driven to move in a plane by the horizontal movement of screw rod nut 1-2 and vertical upwards movement of the point B, and the support rod 1-5 rotates around the axis of a support base;

to retract the lapping platform, the explosion-proof motor 2-1 rotates in reverse direction, so that the screw rod 1-4 rotates in reverse direction and the screw rod nut 1-2 is driven to move in reverse direction, and the support claw 1-6 is retracted along the trace 1-10 and is then reset.

Figure 4:
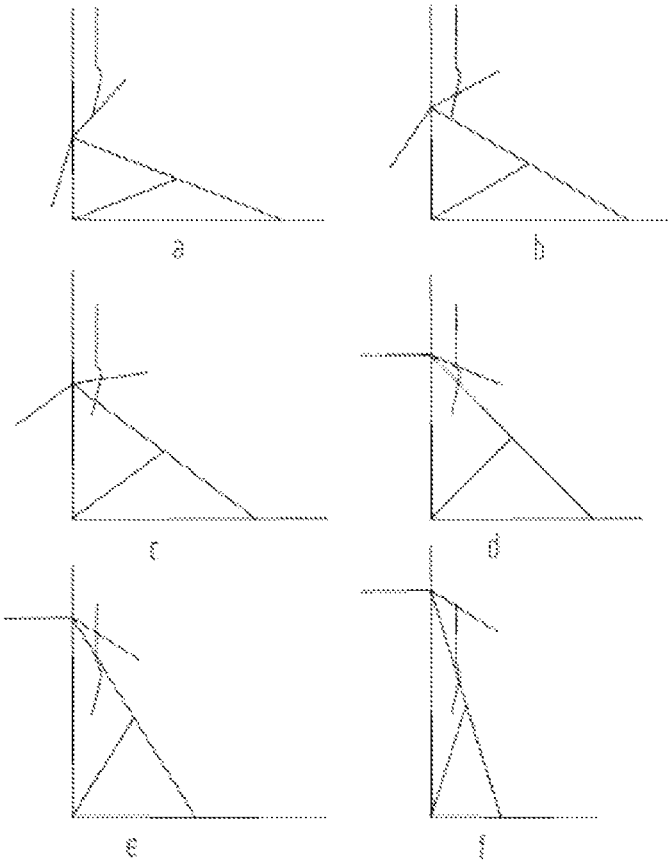
FIGS. 4*a*, 4*b*, 4*c*, 4*d*, 4*e*, and 4*f* are sketch drawings of movement procedures of the present invention.

Before the lapping platform is deployed, the foot board is in an initial position shown in FIG. 4*a*; during deploy of the lapping platform, the explosion-proof motor 2-1 drives the screw rod 1-4 to rotate, the foot board 1-7 translates vertically upwards and rotates around point B in a plane as shown in FIGS. 4*b*-4*d*, till the foot board 1-7 reaches to a horizontal position; then, as the explosion-proof motor 2-1 continues driving, the foot board 1-7 moves vertically upwards as shown in FIGS. 4*e*-4*f*, till the foot board 1-7 reaches a required height; the retraction of the platform is in a reversed sequence, i.e., the foot board 1-7 moves vertically downwards first, and then rotates around point B while it moves vertically downwards, till it returns to the initial position.

AMONG THE DRAWINGS:

1—support claw pack,
2—power pack,
3—beam;
1-1—driven bevel gear,
1-2—screw rod nut,
1-3—push rod,
1-4—screw rod,
1-5—support rod,
1-6—support claw,
1-7—foot board,
1-8—pin shaft,
1-9—guide rail,
1-10—trace,
1-11—tightening screw,
1-12—guide rail bracket,
1-13—mounting base,
1-14—mounting plate,
1-15—screw rod bearing housing,
1-16—support rod shaft;
2-1—explosion-proof motor,
2-2—driving bevel gear.

The invention claimed is:

1. A mining elevator lapping platform suitable for flexible guide rail, comprising:

a support claw package comprising:

two mounting plates arranged in symmetry on a bottom beam of the elevator car;

a support rod shaft arranged on the left between the two mounting plates and fixed via a mounting base;

a screw rod bearing housing arranged in the middle of the two mounting plates at certain spacing to the support rod shaft and perpendicular spatially to the support rod shaft;

a screw rod arranged in the screw rod bearing housing;

a driven bevel gear arranged on the right end of the screw rod;

a screw rod nut fitted over the screw rod;

a push rod hinged to the screw rod nut;

a support rod hinged to the middle part of the push rod and fixed to the support rod shaft; and wherein together the screw rod nut, push rod, support rod, and screw rod constitute an in-line slider-crank mechanism;

a support claw hinged to the other end of the push rod;

a guide rail arranged on the upper part of the support claw and fixed in a guide rail bracket via a pin shaft; and a foot board arranged on the outer side of the lower part of the support claw; and a power package operably coupled to the support claw package comprising:

an explosion-proof motor fixed to the bottom beam of the elevator car; and a driving bevel gear arranged on the output shaft of the explosion-proof motor and engaged with the driven bevel gear.

2. A lapping method for the mining elevator lapping platform suitable for flexible guide rail as set forth in claim 1, comprising:

deploying the lapping platform, wherein the explosion-proof motor drives the driving bevel gear, the driving bevel gear drives the driven bevel gear, and the driven bevel gear drives the screw rod to rotate, so that the screw rod nut fitted over the screw rod moves horizontally, and thus drives the in-line slider-crank mechanism;

wherein the movement of the in-line slider-crank mechanism converts the movement of the push rod into upward vertical translation movement, the support rod rotates around the support rod shaft on the mounting base, and the pin shaft hinged to the support claw on the push rod moves along the trace, so that the foot board fixed to the support claw laps horizontally; and retracting the lapping platform, wherein the explosion-proof motor rotates in a reverse direction, so that the screw rod rotates in a reverse direction and the screw rod nut is driven to move in a reverse direction, and the support claw is retracted along the trace and is then reset.

* * * * *